United States Patent [19]

Cunningham

[11] 4,395,157

[45] Jul. 26, 1983

[54] SAFETY OFF-SHORE DRILLING AND PUMPING PLATFORM

[76] Inventor: Byron H. Cunningham, 1661 Los Piedras Ct., Los Gatos, Calif. 95030

[21] Appl. No.: 281,575

[22] Filed: Jul. 9, 1981

[51] Int. Cl.[3] ..... E02B 17/00; E02D 23/00

[52] U.S. Cl. ..... 405/60; 405/195; 405/210

[58] Field of Search ..... 405/60, 210, 52; 166/357, 79; 210/923

[56] References Cited

U.S. PATENT DOCUMENTS 3,500,841 3/1970 Logan ..... 405/60 X 3,745,773 7/1973 Cunningham ..... 405/60

*Primary Examiner*—Dennis L. Taylor

*Attorney, Agent, or Firm*—Robert G. Slick

[57] ABSTRACT

A safety off-shore drilling, pumping and storage platform for oilwells is provided wherein the structure has a first funnel like structure which floats near the ocean floor connnected by a long tube to a second floating funnel platform which floats on the surface of the water.

4 Claims, 4 Drawing Figures

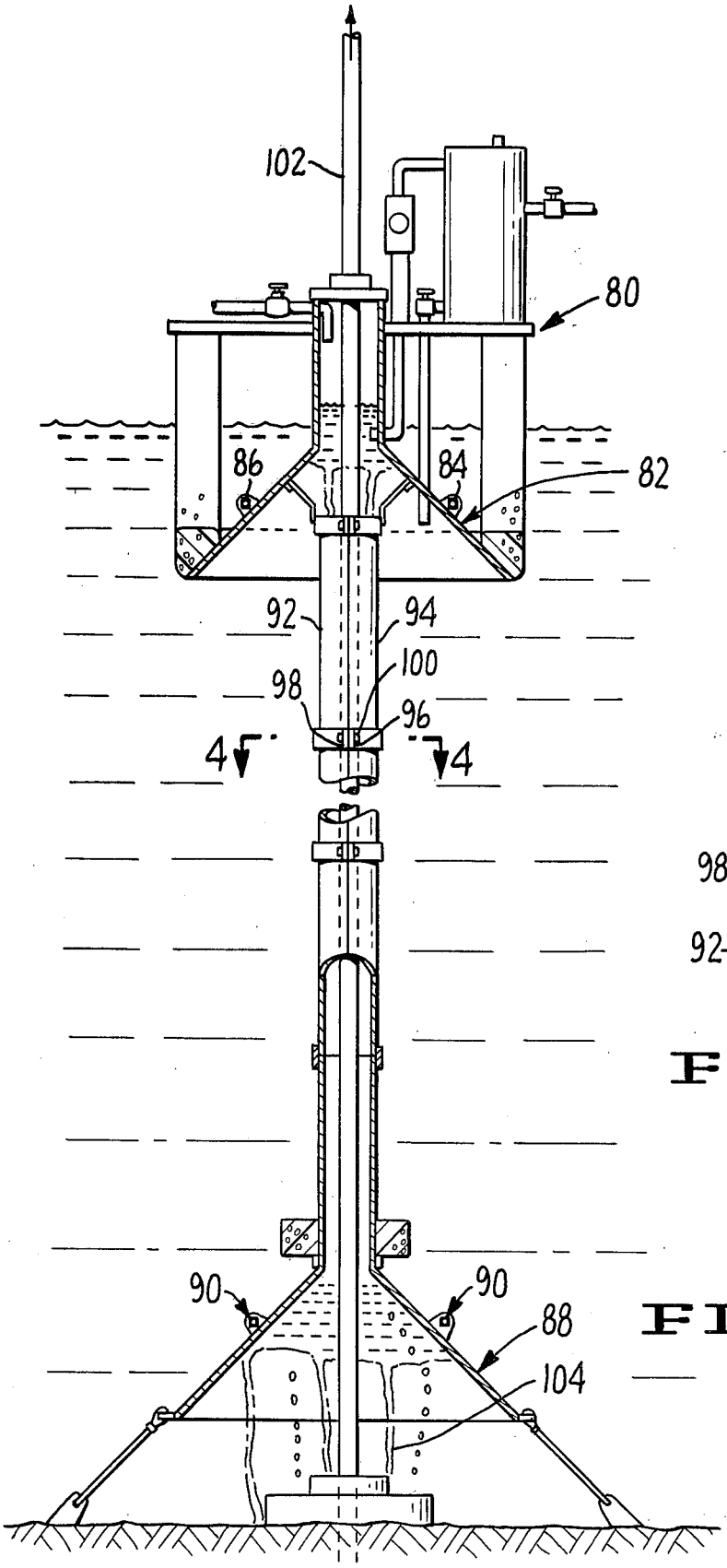
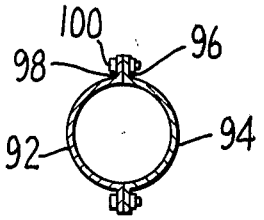
FIG. 4.
FIG. 3.

SAFETY OFF-SHORE DRILLING AND PUMPING PLATFORM

SUMMARY OF THE INVENTION

The present invention relates to an improvement of my prior U.S. Pat. No. 3,745,773 wherein a funnel like structure was mounted on an off-shore drilling or storage platform wherein the drilling and pumping operations could be conducted within the funnel like member with means on the platform for separating oil or water with means for discharging the water back inside the inverted funnel. This structure represented a substantial improvement over the prior art but had several disadvantages. For one thing, it could be used only with a rigid platform anchored to the ocean floor and therefore was not suitable for use with extremely deep wells. The present invention provides two chatchment basins or funnels which are connected by means of a long, light weight tube and wherein both the lower and upper funnel like structures are provided with floatation means so that the structure is not rigidly connected to the ocean floor.

Thus, the present invention differs from my prior patent in the provision of floating members which are anchored by cables to the ocean floor. The upper portion of the present invention is an exact duplicate of the original funnel and tube except that a lower funnel is provided immediately above the ocean floor and the two funnel like structures are connected to each other with sections of light weight tubing which may conveniently come in 50, 100 or 1,000 foot sections joined together. Thus the present invention is not limited to the use of rigid platforms but instead may be used with wells in water of almost any depth.

The tubular section connecting the two basins can be constructed of a light, flexible material such as aluminum or even consist of solid ribs with fabric walls of cloth or plastic. Some sections of the tube might be composed in part of asbestos if there is any possibility of the tube sections being exposed to fires of burning oil. Each end of each of the tube sections is fitted with a metal collar enabling sections to be joined together to provide tubes of any length or attached to the top of the respective funnel sections.

The funnel sections themselves can also be constructed of light flexible material such as aluminum and again may consist merely of solid ribs with natural or artificial fabric forming the actual wall of the funnel. Attached to each of the funnel like sections is some form of float and the sections are held down by cables which lead to anchors buried in the ocean floor. Thus, the structures are extremely flexible and will yield, to some extent, to tides and currents so that they will be much less likely to be injured by exposure to the elements.

Since the pipes connecting the sections are flexible, it is not necessary that one funnel be located directly above the other. Thus it is entirely feasible, in the case of an oil blowout, and particularly one which has caught fire, to have the upper funnel off to one side of the blowout and to move the lower funnel under water to contain the blowout so that the fire can be automatically extinguished.

In accordance with another embodiment of the invention, tube sections are constructed in such a way that the tubes can be opened from top to bottom (vertically) so that the structure can be installed around an existing drilling string and fastened around the string to contain any leakage of oil or gas.

Various other embodiments and features of the invention will be described in the balance of the specification.

BRIEF DESCRIPTION OF THE DRAWINGS

FIG. 3 shows another embodiment of the invention wherein the funnels and tubes are provided with vertical openings so that the structure can be installed around an existing building screen.

FIG. 4 is a section on the line 4—4 of FIG. 3.

DESCRIPTION OF THE PREFERRED EMBODIMENTS

Figure 1:
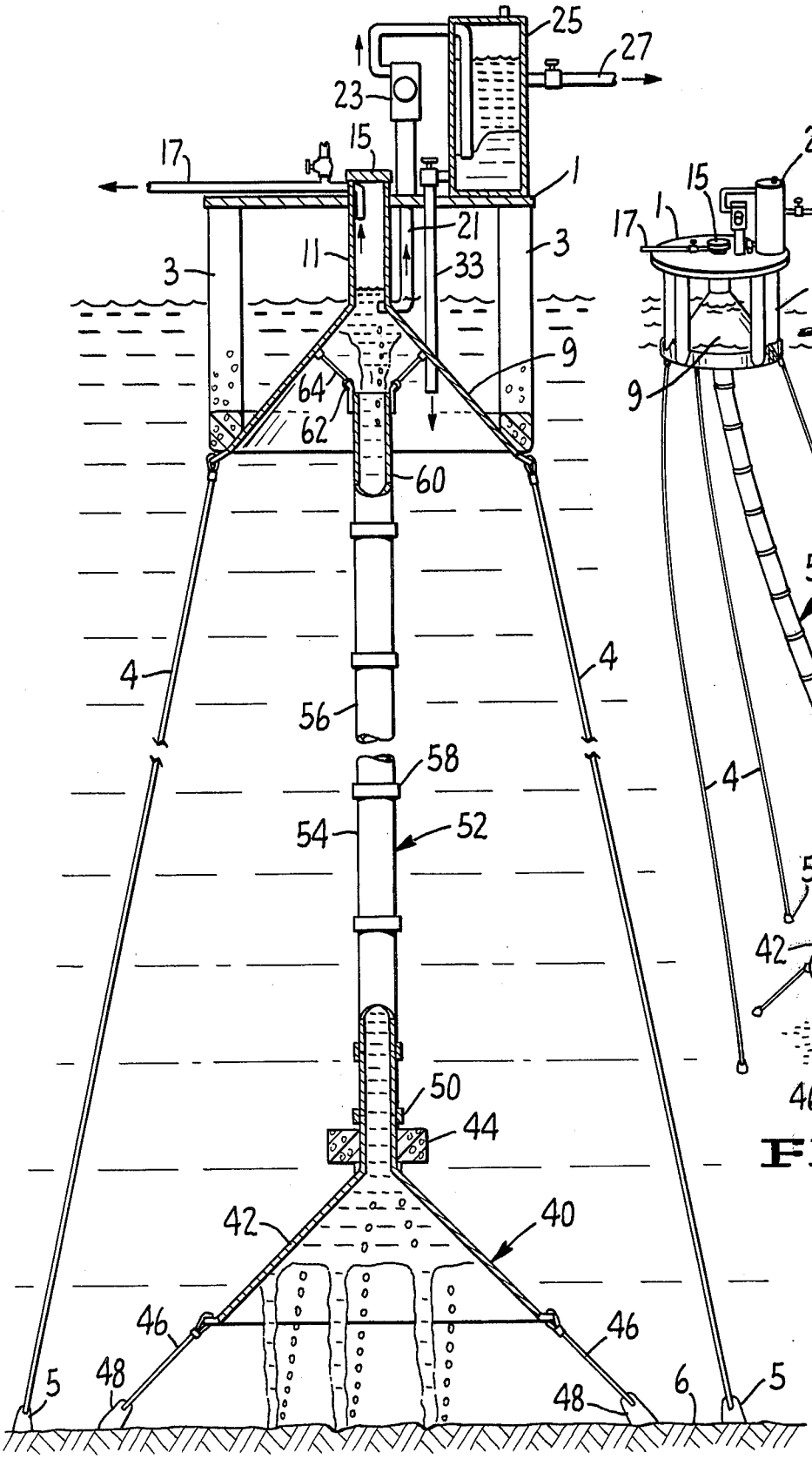
FIG. 1 is a side view, partly in section, of an off-shore drilling and pumping platform embodying the present invention.

Refering now to the drawings now by reference characters there is shown on oil well drilling and storage platform 1 having floats 3 and which is held in place by cables 4 attached to anchors 5 in the ocean floor 6. The upper catchment basin consists of an inverted funnel like member 9 having a tubular section 11 leading to the top of the platform 1. The top of the tubular portion 11 is sealed as at 15 and gas is taken off through line 17 while oil, or a mixture of oil and water is taken off through line 21 and is taken through pump 23 to the separation vessel 25 where oil is separated from water and the oil is taken off through line 27 as an upper phase while a lower phase of water is passed through pipe 33 back inside the catchment basin 9. This structure is essentially the same as described in my prior patent except that in this case the platform 1 may be provided with floats, rather than legs, and held in place by cables anchored to the ocean floor rather than being held in place by a rigid structure.

A lower catchment basin generally designated 40 is provided, the lower catchment basin taking the form of an inverted funnel 42 which may be a solid structure or a light structure as previously described. The funnel 42 is shown as being substantially the same size as the funnel 9 although, in a practical embodiment of the invention the funnels might be of different sizes and it is particularly desirable that the lower funnel be larger than the upper particularly if oil is seeping from a number of fissures in the ocean floor. The upper portion of funnel 42 is provided with a floatation collar 44 and is held down by cables 46 attached to anchors 48 in the ocean floor 6. Directly above the float 44 is a metal collar 50 which is adapted to attach lower funnel 40 with a string of pipe generally designated 52. The pipe string 52 consists of a plurality of sections of pipe as at 54 and 56 which are suitable collars 58 for coupling the sections together. These pipe sections can be made of light weight material as previously described and can come in a variety of lengths, e.g. 50 feet, 100 feet, and 1,000 feet so that the separation between the two funnels 9 and 40 can be very great. The upper section of the tube string 60 has a collar 62 thereon so that it can be attached by cables 64 to the inner surface of the funnel 9. This, of course, provides a flexible connection so that the device can give considerably in storms, tides or currents.

In operation, lower catchment basin 40 collects oil seeping from the ocean floor 6 and directs it upwardly through the tube 42 where it is released into the upper funnel 9 where it can be processed as described in my prior patent. Since the upper funnel is directly above the lower one in this case, if there should be some leakage along the pipe string 52 it would be caught by the upper funnel without causing any damage.

Figure 2:
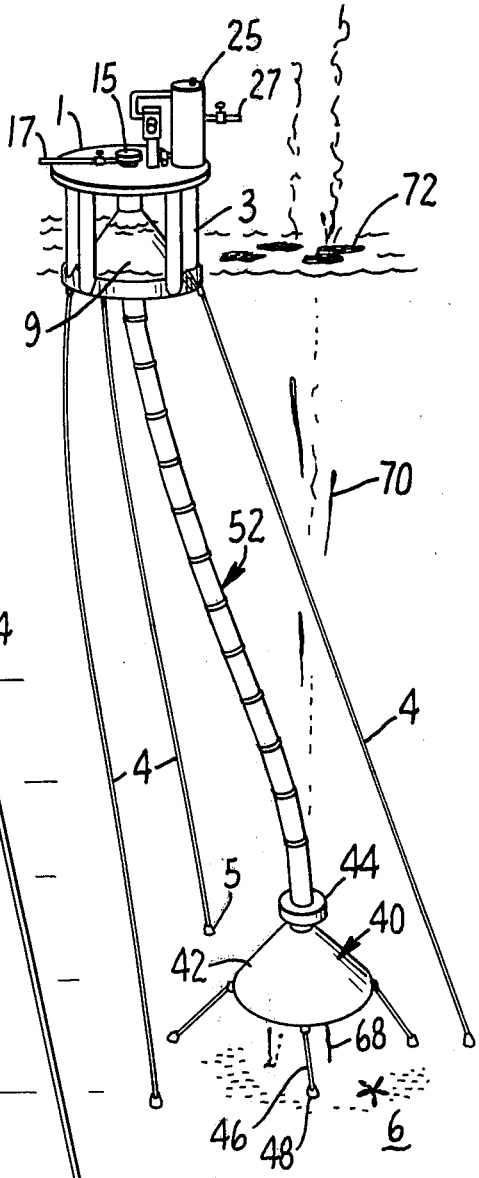
FIG. 2 is a side view of a platform embodying the present invention showing how the top and bottom sections can be placed horizontally to each other so as to contain an existing blowout or fire.

In FIG. 2 it is shown how a structure made in accordance with the present invention can be used to snuff out a fire or to catch a blowout in the ocean floor. Here there has been a blowout 68 in the ocean floor and the oil and gas as at 70 rise through the ocean and may catch fire on the surface of the ocean as at 72. The upper floating platform 1 is placed a safe distance from the emerging oil, gas and possibly flame 72 and the lower funnel 40 is manuvered over the area 68 of the ocean floor where the escape is taking place. In this manner, the escaping oil and gas 68 on the ocean floor will be caught and conveyed by the flexible tubing 52 to the upper funnel 9 so that the fire will go out for lack of fuel. After the flames have gone out, platform 1 could be manuvered directly over the funnel 40 if this is desired.

At times, there will be a situation where there is an existing oil well with a pipe coming from the well but wherein a leak occurs at some point around the edge of the pipe. The structure of the present invention lends itself to containing oil leaks in such a situation as is shown in FIGS. 3 and 4. In this embodiment of the invention, both the funnels and the tubing connecting them have vertical seams so that the unit can be moved upon an existing drilling string or oil recovery pipe merely by separating the sections, placing them around the pipe and clamping them together. The platform generally designated 80 is connected to a funnel generally designated 82 and this funnel is made in sections held together my means of bolts 84 which pass through lugs 86 on the funnel. The bottom funnel 88 is provided with similar lugs and bolts as at 90. The tubing sections, as is best seen in FIG. 4 are split along a vertical seam and thus are in the form of two halves 92 and 94 which have the lugs 96 and 98 thereon held together with bolt 100, or vertical seams of lighter material could be held together with an adhesive substance at a single vertical opening, and reinforced with an adhesive or mastic tape applied over the closure. This would allow for quick assembly and installation and the use of less expensive materials. Thus, the structure of the present invention can be separated on a vertical line and moved into place and clamped around an existing oil recovery pipe 102 so that any seepage as at 104 around the base of the pipe is contained and salvaged as previously described. In this instance, cables are shown only for holding the lower funnel 88 since the pipe 102 tends to hold the upper funnel and the connecting tubing in place. However, if desired, the upper funnel might be provided with cables and anchors as previously described.

It should be noted that when the upper floating platform and funnel are not being used to recover oil from the ocean floor they can be anchored alongside a producing oil platform and used to store oil for later offloading to a tanker ship, so that it would not be necessary to construct an expensive pipeline to bring the oil to a shore location or have a tanker ship standing by for storage. This provides a continuing constructive use for the upper portion of the recovery system when not used for emergency purposes. The size of the upper floating funnel can be constructed to any size suitable for storage of great quantities of oil, and when used for storage purposes, the guage of the metal or other material used should be of sufficient strength to withstand the force of ocean weather and waves. A flexible means is used to anchor the platform to the ocean floor such as the cables shown in FIG. 1.

It is believed apparent from the foregoing that I have provided an improved safety off-shore drilling, pumping and storage platform which is capable of operating in great depths but which is relatively inexpensive to construct and light in weight. Also in accordance with one embodiment of the invention, the tubing and funnel structures can be split along vertical lines so that they can be installed around existing oil well piping.

Although certain specific embodiments of the invention have been described, it will be apparent to those skilled in the art that many variations can be made in the exact structure shown without departing from the spirit of this invention.

Subject matter to be claimed is:

1. A safety off-shore drilling, pumping and storage platform comprising in combination:

a. a surface floating platform comprising a catchment basin in the form of a first inverted funnel having flotation means thereon and flexible means for anchoring said platform to the ocean floor, b. a second catchment basin being in the form of an inverted submerged funnel, said basin having flotation means thereon and flexible anchoring means for attaching said funnel to the ocean floor, and c. a flexible lightweight tube connecting said lower funnel to said upper funnel.

2. The structure of claim 1 wherein the light weight tube is formed in a plurality of sections with clamping means for attaching the sections together.

3. The structure of claim 1 wherein said tube is split vertically into sections of varying means to clamp the vertical sections together.

4. The structure of claim 1 wherein the first catchment basin is displaced horizontally from the second catchment basin.

* * * * *